US008814607B2

(12) United States Patent
Da Silva

(10) Patent No.: US 8,814,607 B2
(45) Date of Patent: Aug. 26, 2014

(54) ELECTRIC CONNECTION TERMINAL

(71) Applicant: ABB France, Courtaboeuf Cedex (FR)

(72) Inventor: Franck Da Silva, Saint Savin (FR)

(73) Assignee: ABB France (FR)

( * ) Notice: Subject to any disclaimer, the term of this patent is extended or adjusted under 35 U.S.C. 154(b) by 73 days.

(21) Appl. No.: 13/755,797

(22) Filed: Jan. 31, 2013

(65) Prior Publication Data

US 2013/0203301 A1 Aug. 8, 2013

(30) Foreign Application Priority Data

Feb. 3, 2012 (FR) ..... 12 51034

(51) Int. Cl.
*H01R 4/38* (2006.01)

(52) U.S. Cl.
USPC ..... 439/811; 439/793

(58) Field of Classification Search
USPC ..... 439/811, 812, 791–793
See application file for complete search history.

(56) References Cited

U.S. PATENT DOCUMENTS 4,629,281 A * 12/1986 Kruger ..... 439/791
4,790,778 A * 12/1988 Seidenbusch ..... 439/811
5,580,285 A * 12/1996 Vanzetto ..... 439/810
5,664,971 A * 9/1997 Coy ..... 439/811
6,475,038 B1 * 11/2002 Franck ..... 439/811
6,719,593 B2 * 4/2004 Garcia et al. ..... 439/811
7,404,745 B1 * 7/2008 Wu ..... 439/811
2005/0020145 A1 * 1/2005 Leitl et al. ..... 439/811

FOREIGN PATENT DOCUMENTS

| | | | |
|---|---|---|---|
| DE | 2107218 | A1 | 8/1972 |
| DE | 19962289 | A1 | 6/2001 |
| EP | 1796214 | A1 | 6/2007 |
| EP | 1936743 | A2 | 6/2008 |
| FR | 2612340 | A1 | 9/1988 |
| FR | 2766297 | A1 | 1/1999 |

* cited by examiner

*Primary Examiner* — Gary Paumen
(74) *Attorney, Agent, or Firm* — Cantor Colburn LLP

(57) ABSTRACT

A terminal including a cage comprising a counter-support wall; a yoke including a supporting wall delimiting with said counter-support wall a first clamping location, laid out so as to allow the introduction of at least one first conducting element; and a front wall; a clamping member; where the clamping member delimits with the supporting wall of the yoke a second clamping location; and the front wall of the yoke is provided with a lumen laid out so as to allow introduction into the second clamping location of at least one second conducting element along a second direction parallel to the first direction.

9 Claims, 5 Drawing Sheets

ELECTRIC CONNECTION TERMINAL

TECHNICAL FIELD

The present invention relates to an electric connection terminal, as well as to an assembly including this terminal.

BRIEF DESCRIPTION OF RELATED ART

A connection terminal according to the invention for example finds application for fitting out an electric appliance, such as an electric contacter.

An electric contacter is conventionally equipped with a fixed contact support jutting out outwards from its casing. This fixed contact support is connected to a circuit enclosed by said casing on the one hand and connected to one or several cables by means of a connection terminal on the other hand.

An electric connection terminal 1 with screws (partly illustrated in FIG. 1) is known from document FR2766297. The terminal 1 includes:

- a cage 2 comprising a counter-support wall 4;
- a yoke 6 including a supporting wall 8 delimiting with the counter-support wall 4 a first clamping location 10;
- an added part 12 on the supporting wall 8 of the yoke 6 and delimiting with this supporting wall 8 a second clamping location 14; and
- a screw 16 laid out so that its rotation relatively to the cage 2 causes translation of the cage 2 relatively to the yoke 6, and subsequently rotation of the part 12 relatively to the yoke 6.

The first clamping location 10 is laid out so as to allow introduction of a fixed contact support 18 of a contacter, and of the exposed end of two cables 20 and 22.

The second clamping location 14 is laid out so as to allow the introduction of an endpiece 24 of a cable 26.

The terminal 1 gives satisfaction insofar that it allows electric connection of the contact support 18 to a plurality of cables 20, 22, and 26.

However, the terminal 1 has a consequent number of components which is desirably reduced, for reasons of mounting simplicity and manufacturing cost.

Further, it is desirable to increase the volume of the first clamping location 10, while keeping a second clamping location so as to increase the number or the size of the conducting elements which may be introduced into the first clamping location.

BRIEF SUMMARY

The invention aims at achieving these goals.

The invention relates to an electric connection terminal including:

- a cage comprising a counter-support wall;
- a yoke comprising:
  - a supporting wall delimiting with said counter-support wall a first clamping location, this first clamping location being laid out so as to allow the introduction of at least one conducting element along a first direction; and
  - a front wall perpendicular to said first direction;
- a clamping member for translationally driving the cage relatively to the yoke along an axis;

characterized in that the clamping member delimits with the supporting wall of the yoke a second clamping location; and in that the front wall of the yoke is provided with a lumen laid out for allowing introduction into the second clamping location of at least one second conducting element along a second direction.

Preferably, the second direction is parallel to the first direction.

For example, the clamping member laid out so that a rotation of the clamping member relatively to the cage around an axis causes translation of the cage relatively to the yoke following this same axis.

The terminal according to the invention is without any added part on the supporting wall of the yoke.

The terminal according to the invention thus has a more voluminous first clamping location than the one of the terminal of the state of the art, while keeping a second clamping location. Under these conditions, the number or the size of the conducting elements which may be received in the first clamping location is increased.

Further, the terminal according to the invention has a reduced number of components as compared with the terminal of the state of the art. Also, its mounting method is simpler and faster to apply and its price cost is reduced.

Finally, the terminal according to the invention allows the connection of a cable with a small diameter parallel to a cable of a large diameter received in the first clamping location.

The terminal according to the invention may include one or more of the following features.

Advantageously, the lumen is rectangular.

Under these conditions, the second conducting element may assume the form of a tab intended to connect the connection terminal according to the invention to an additional connection terminal.

According to a feature of the invention, the dimension of the second clamping location defined between the clamping member and the supporting wall of the yoke is laid out so as to decrease when the clamping member is driven into rotation.

According to a feature of the invention, the clamping member is common for the first clamping location and for the second clamping location.

According to a feature, the cage comprises a screwing wall, opposite to the counter-support wall, and in which a tapped or threaded orifice is made; and the clamping member comprises:

- a drive portion designed so as to be driven into rotation;
- a threaded or tapped intermediate portion adapted so as to be screwed into said tapped or threaded orifice made in the screwing wall; and
- a supporting portion delimiting with the supporting wall of the yoke the second clamping location.

Advantageously, the clamping member comprises a connecting portion connecting the intermediate portions to the supporting portion, the connecting portion having a smaller diameter than the diameter of the supporting portion and of the intermediate portion;

and the yoke comprises a retaining wall opposite to the supporting wall, in which a first portion is made with an orifice of a smaller diameter than the diameter of the supporting portion and of the intermediate portion; and the connecting portion extends through this first orifice portion, so as to ensure that the yoke is retained at the clamping member along the axis of rotation of the clamping member.

According to a feature, the connecting portion of the clamping member has a greater length than the thickness of the retaining wall of the yoke.

Under these conditions, a relative movement of the clamping member relatively to the yoke along its axis of rotation is allowed, so that a conducting element may be clamped in the first clamping location even in the absence of a conducting element in the second clamping location.

Advantageously, the yoke comprises a rear wall opposite the front wall, and in which is made a second orifice portion communicating with the first orifice portion; and the supporting portion of the clamping member is conformed so as to be engaged into the second orifice portion, transversely to its axis of rotation, and to subsequently allow the positioning of the connection portion of the clamping member in the first orifice portion.

In a preferred embodiment, the yoke is made by plastic deformation of a metal blade, so that a first portion of the blade forms the front wall, a second portion forms the supporting wall, a third portion forms the rear wall and a fourth portion forms the retaining wall.

Thus, the method for manufacturing the yoke is simple to apply.

Still in this preferred embodiment, the cage is made by plastic deformation of a metal blade, so that at least one first portion of the blade forms the screwing wall, a second portion forms a first connecting wall, a third portion forms the counter-support wall and a fourth portion forms a second connecting wall.

Thus, the method for manufacturing the cage is also simple to apply.

The invention also relates to an assembly characterized in that it includes:

- a terminal in accordance with any of the terminals presented hereinbefore;
- a so-called second conducting element introduced into said second clamping location along said second direction;
- an additional terminal electrically connected to said second conducting element, and intended to be connected to a third conducting element, such as a cable.

BRIEF DESCRIPTION OF THE DRAWINGS

The invention will be better understood by means of the description which follows with reference to the appended schematic drawing illustrating, as an example, an electric connection terminal according to the invention.

DETAILED DESCRIPTION

Figure 1:
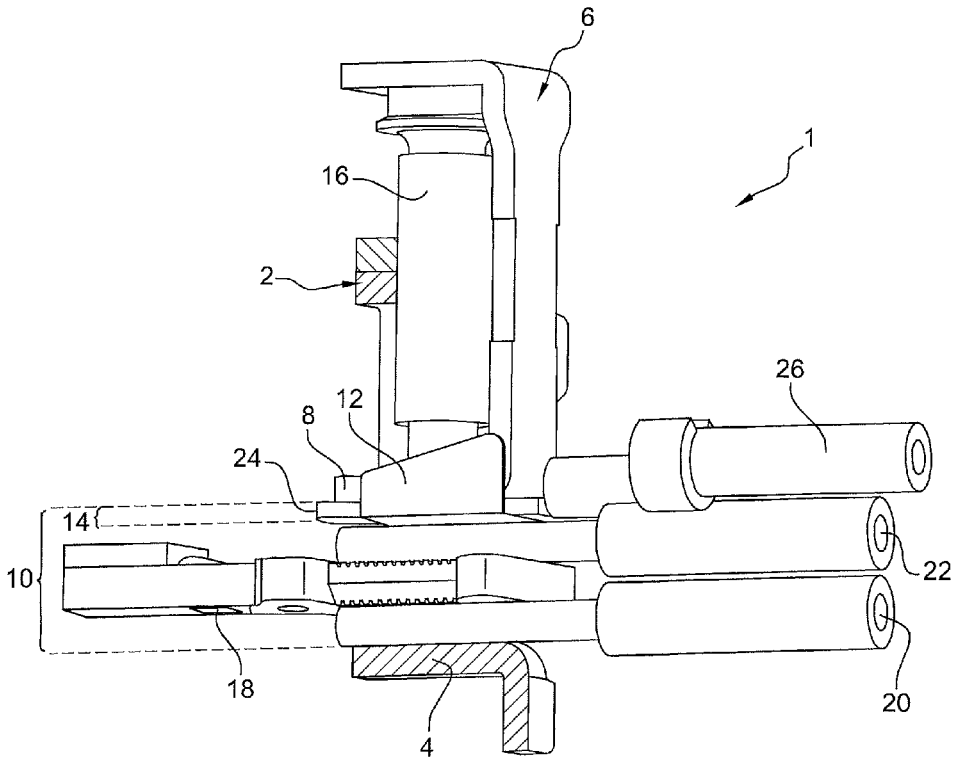
Fig. 1 PRIOR ART
FIG. 1 is a sectional view of a connection terminal of the state of the art.
Figure 2:
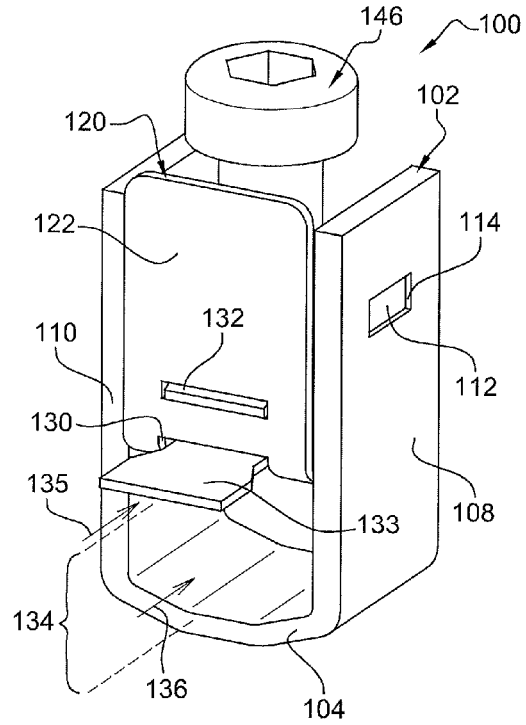
FIG. 2 is a perspective view of a connection terminal according to the invention.
Figure 3:
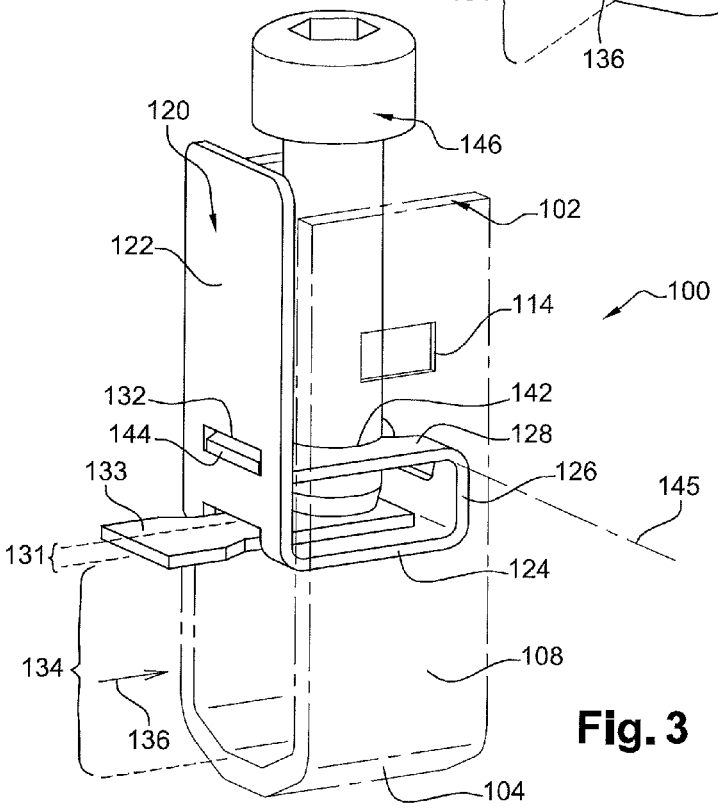
FIG. 3 is a perspective view of the terminal of FIG. 2 on which a cage is illustrated transparently.
Figure 4:
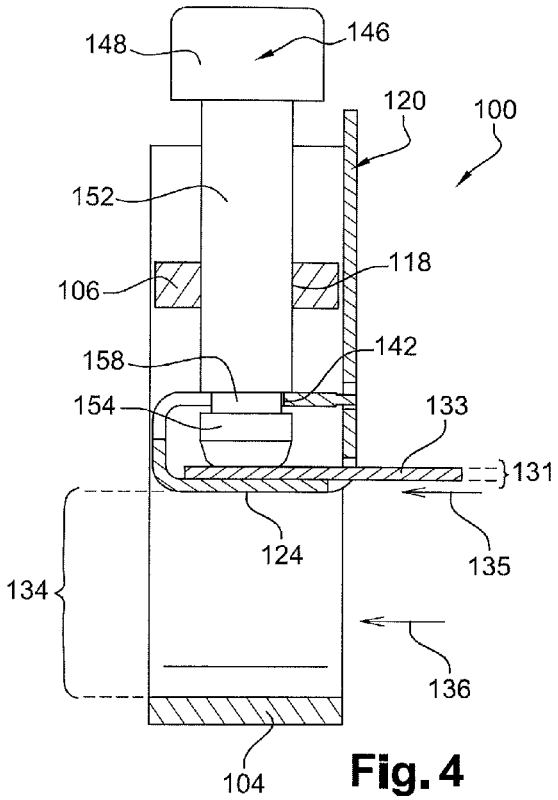
FIG. 4 is a sectional view of the terminal of FIG. 2.

FIGS. 2 to 4 illustrate an electric connection terminal 100 according to the invention. The terminal 100 includes a cage 102 comprising:

- a counter-support wall 104;
- a screwing wall 106 (illustrated in FIG. 4) opposite to the counter-support wall 104; and
- connecting walls 108 and 110 connecting the counter-support wall 104 to the screwing wall 106.

The cage 102 is made by plastic deformation of a metal blade, so that a first portion of this blade forms the connecting wall 108, a second portion forms the counter-support wall 104 and a third portion forms the connecting wall 110.

The screwing wall 106 is added and attached to the connecting walls 108 and 110. For this purpose, the screwing wall 106 comprises two protrusions 112, and each connecting wall 108 and 110 comprises a notch 114 inside which a respective protrusion 112 is engaged.

The screwing wall 106 is provided with a tapped orifice 118.

Figure 5:
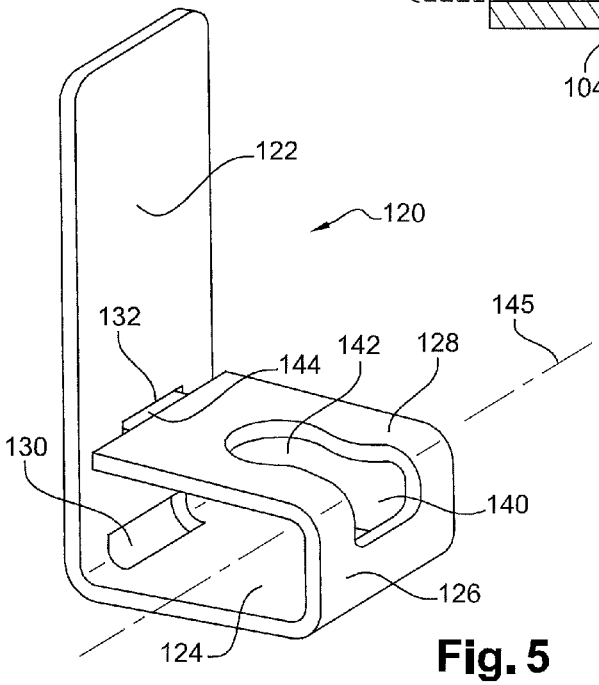
FIG. 5 is a view of a yoke fitting out the terminal of FIG. 2.

The terminal 100 comprises a yoke 120 (illustrated in FIG. 5). This yoke 120 comprises:

- a front wall 122;
- a supporting wall 124;
- a rear wall 126 opposite to the front wall 122; and
- a retaining wall 128 opposite to the supporting wall 124.

The yoke 120 is made by plastic deformation of a metal blade, so that a first portion of the blade forms the front wall 122, a second portion forms the supporting wall 124, a third portion forms the rear wall 126 and a fourth portion forms the retaining wall 128.

The front wall 122 is laid out so as to obturate all or part of the inner volume of the cage 102. The front wall 122 is provided with rectangular lumens 130 and 132.

The lumen 130 is laid out for allowing introduction of a conducting element 133 along a direction 135 into a clamping location 131. The direction 135 is perpendicular to the front wall 122.

The supporting wall 124 delimits with the counter-support wall 104 of the cage 102 a clamping location 134. This clamping location 134 is laid out so as to allow introduction of at least one conducting element, for example a fixed contact support of a contacter and the exposed ends of one or several cables (not shown), along a direction 136 parallel to the direction 135.

The rear wall 126 is provided with a rectangular orifice portion 140. The retaining wall 128 is provided with a circular orifice portion 142 communicating with the orifice portion 140.

The retaining wall 128 is extended by a tab 144 engaged into the lumen 132. Play is made between the tab 144 and the lumen 132. Under these conditions, the retaining wall 128 may pivot relatively to the rear wall 126 around an axis 145 (illustrated in FIG. 3) by elastic deformation.

Figure 6:
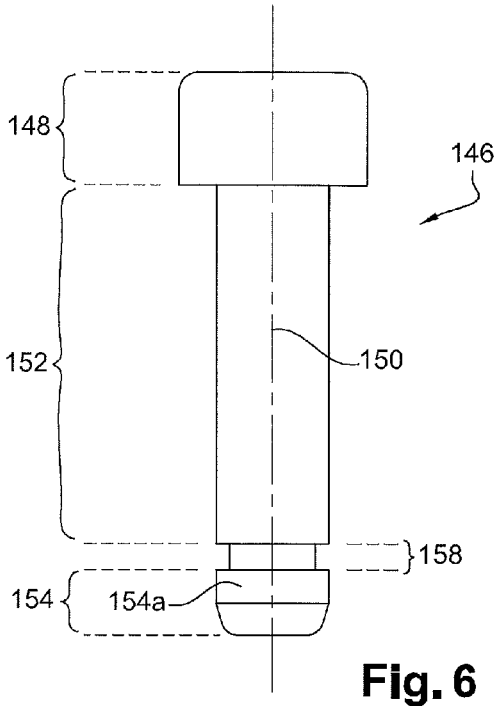
FIG. 6 is a side view of a clamping member of the terminal of FIG. 2.

The terminal 100 finally includes a clamping member 146 (illustrated in FIG. 6) laid out so that a rotation of the clamping member 146 relatively to the cage 102, around an axis 150, causes translation of the cage 102 relatively to the yoke 146 along this same axis 150.

The clamping member 146 is cylindrical. It comprises:

- a drive portion 148 designed so as to be driven into rotation, for example by means of an Allen wrench, around the axis 150;
- a threaded intermediate portion 152, adapted so as to be screwed into the orifice 118 made in the screwing wall 106 of the cage 102;
- a supporting portion 154 delimiting with the supporting wall 124 of the yoke 120 the clamping location 131 mentioned earlier; and
- a connecting portion 158 connecting the supporting portion 154 and the intermediate portion 152.

The drive portion 148 has a diameter greater than the diameter of the orifice 118 made in the screwing wall 106 of the cage 102.

Under these conditions, the drive portion 148 forms an abutment which may bear against the screwing wall 106 when the clamping member 146 moves, relatively to the cage 102, in translation along the axis 150.

The connecting portion 158 has a smaller diameter than the diameter of the intermediate portion 152 and the diameter of a segment 154*a* of the supporting portion 154 turned towards the connecting portion 158.

Further, the diameter of the intermediate portion 152 and the diameter of the segment 154*a* of the supporting portion 154 are greater than the diameter of the orifice portion 142 made in the retaining wall 128 of the yoke 120.

Under these conditions, the retaining wall 128 ensures that the yoke 120 is retained at the clamping member 146, in response to a force exerted on the yoke 120 along the axis 150.

Finally, the length of the connecting portion 158 is greater than the thickness of the retaining wall 128 so that a conducting element may be clamped in the clamping location 134 even in the absence of the conducting element 133 in the clamping location 131.

Therefore, the clamping member 146 is common to the first clamping location 134 and to the second clamping location 131.

By common, it should be understood that the same clamping member 146 is used for varying both the dimension of the first location 134 and the dimension of the second location 131 and therefore used for carrying out both clamping of cables in the first location 134 and of a conducting element in the second location 131.

The supporting portion 154 is conformed so as to be engaged into the orifice portion 140 made in the rear wall 128 of the yoke 120, transversely to the axis 150, and subsequently allow the positioning of the connecting portion 158 through the orifice portion 142 made in the retaining wall 128 of the same yoke 120.

A method for using the terminal 100 is now described.

When the terminal 100 is positioned in the body of an electric appliance, a fixed contact support 170 is housed in the clamping location 134.

During a first step, a user introduces the conducting element 133 into the lumen 130 along the direction 135. The conducting element 133 then extends between the supporting portion 154 of the clamping member 146 and the supporting wall 124 of the yoke 120 (as illustrated in FIGS. 2 to 4).

During a second step, the user introduces one or several exposed ends of one or several cables into the clamping location 134, for example of two cables on either side of the fixed contact support 170.

During a third step, the user drives the clamping member 146 into rotation relatively to the cage 102, for example by means of an Allen wrench. In response, the yoke 120 moves relatively to the cage 102, until the fixed contact support and the exposed ends of two cables are nipped between the supporting wall 124 of the yoke 120 and the counter-support wall 104 of the cage.

Moreover, the conducting element 133 is nipped between the supporting portion 154 of the clamping member 146 and the supporting wall 124.

It should be noted that the first and second steps described above may be reversed.

However, the dimension of the second clamping location 131 defined between the clamping member 146 and the supporting wall 124 of the yoke 120 is laid out so as to decrease when the clamping member 146 is driven into rotation.

Indeed, when the clamping member 146 is driven into rotation in order to reduce the dimension of the first clamping location 134 and that the supporting wall 124 will abut against both cables or even the counter-support wall 104 if no cable is inserted into the first clamping location 134, then the dimension of the second clamping location 131 delimited by the clamping member 146 and the supporting wall 124 of the yoke 120 decreases until the clamping member 146 is in abutment against the second conducting element 133 or even the supporting wall 124 if no second conducting element is introduced into the second location 131.

Of course, the clamping member 146 may be directly put into contact with the second conducting element 133 or with the supporting wall 124 or else indirectly via a mobile part under the action of the clamping member 146.

Figure 7:
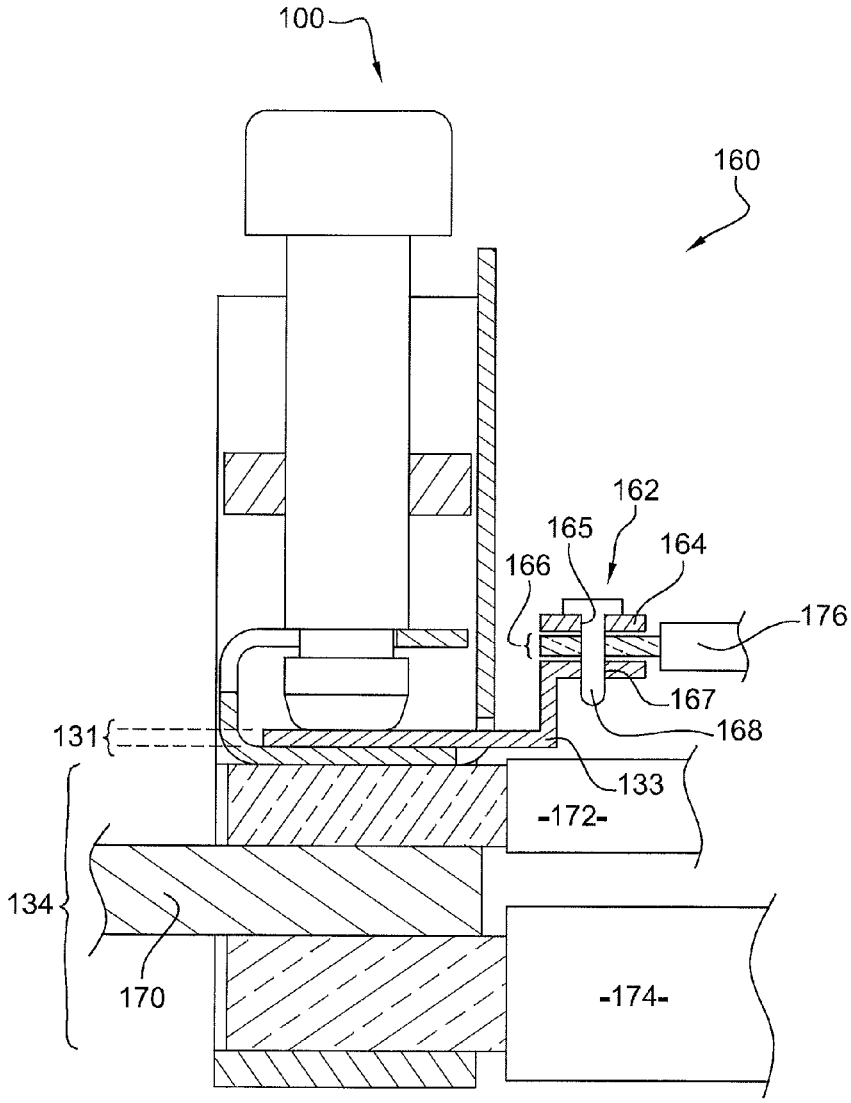
FIG. 7 is a view of an assembly including the terminal of FIG. 2 connected to an additional terminal.

FIG. 7 illustrates an assembly 160 according to the invention including:

- the terminal 100;
- a simple terminal 162 comprising a washer 164 forming a supporting wall, the washer 164 being provided with a through-orifice 165, and delimiting a clamping location 166 with a conducting element 133, and a clamping member 168 which may be screwed into the tapped orifice 165 and into a tapped orifice 167 made in the conducting element 133 positioned oppositely;
- the conducting element 133 introduced into the clamping location 131 of the terminal 100;
- a fixed contact support 170 of a contacter and the exposed ends of two cables 172 and 174 in the clamping location 134 of the terminal 100; and
- a cable 176, having a smaller diameter than those of the cables 172 and 174, and the exposed end of which is introduced into the clamping location 166 of the terminal 162.

Such an assembly gives the possibility of connecting as a cascade, a plurality of cables with different diameters to a fixed support of an electric contacter.

As this is obvious, the invention is not limited to the sole embodiment of the terminal described above as an example, on the contrary it encompasses all the alternative embodiments.

Figure 8:
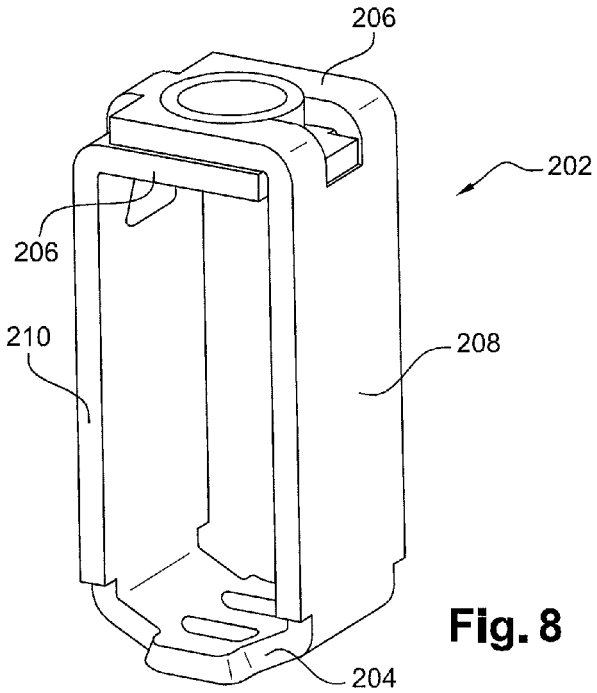
FIG. 8 is a perspective view of an alternative embodiment of the cage fitting out the terminal of FIG. 2.

Alternatively, the cage 102 may be replaced with a cage 202 (shown in FIG. 8). The cage 202 differs from the cage 102 in that it comprises two clamping walls 206 each provided with a tapped orifice 208, and superposed on each other. The clamping walls 206 are made with the connecting walls 208 and 210, and the counter-support wall 204 in the same material.

The cage 202 is made by plastic deformation of a metal blade, so that a first portion of the blade forms a first screwing wall 206, a second portion forms the connecting wall 208, a third portion forms the counter-support wall 204, a fourth portion forms the connecting wall 210, and a fifth portion forms another screwing wall 206.

Alternatively, the clamping member 146 may be replaced with a clamping member (not shown) differing in that the drive portion has the same diameter as the intermediate portion.

Still alternatively, the clamping member 146 may finally be replaced with a clamping member (not shown) differing in that the drive portion is adapted so as to be driven into rotation relatively to the cage 102 by means of a flat-blade or Phillips screwdriver.

The invention claimed is:

1. An electric connection terminal including:

a cage comprising a counter-support wall;

a yoke comprising:

a supporting wall delimiting with said counter-support wall a first clamping location, this first clamping location being laid out so as to allow introduction of at least one first conducting element along a first direction; and a front wall transverse to said first direction;

a clamping member laid out for driving the cage into translation relatively to the yoke along an axis;

wherein the clamping member delimits with the supporting wall of the yoke a second clamping location; and wherein the front wall of the yoke is provided with a lumen laid out for allowing introduction into the second clamping location, of at least one second conducting element along a second direction.

2. The terminal according to claim 1, wherein the lumen is rectangular.

3. The terminal according to claim 1, wherein the cage comprises a screwing wall, opposite to the counter-support wall, and in which is made a tapped or threaded orifice; and wherein the clamping member comprises:

a drive portion designed so as to be driven into rotation;

a tapped or threaded intermediate portion adapted so as to be screwed into said tapped or threaded orifice made in the screwing wall; and a supporting portion delimiting with the supporting wall of the yoke the second clamping location.

4. The terminal according to claim 3, wherein the clamping member comprises a connecting portion connecting the intermediate portion to the supporting portion, the connecting portion having a smaller diameter than the diameter of the supporting portion and of the intermediate portion;

in that the yoke comprises a retaining wall opposite to the supporting wall, in which a first orifice portion is made with a diameter smaller than the diameter of the supporting portion and of the intermediate portion; and in that the connecting portion extends through this first orifice portion, so as to ensure that the yoke is retained at the clamping member along the axis of rotation of the clamping member.

5. The terminal according to claim 4, wherein the connecting portion of the clamping member has a greater length than the thickness of the retaining wall of the yoke.

6. The terminal according to claim 4, wherein the yoke comprises a rear wall opposite to the front wall, and in which is made a second orifice portion communicating with the first orifice portion; and wherein the supporting portion of the clamping member is conformed so as to be engaged into the second orifice portion, transversely to its axis 150 of rotation, and subsequently allow the positioning of the connecting portion of the clamping member in the first orifice portion.

7. The terminal according to claim 6, wherein the yoke is made by plastic deformation of a metal blade, so that a first portion of the blade forms the front wall, a second portion forms the supporting wall, a third portion forms the rear wall and a fourth portion forms the retaining wall.

8. The terminal according to claim 1, wherein the cage is made by plastic deformation of a metal blade, so that at least one first portion of the blade forms the screwing wall, a second portion forms a first connecting portion, a third portion forms the counter-support wall and a fourth portion forms a second connecting wall.

9. An assembly comprising:

a terminal according to claim 1;

a so-called second conducting element introduced into said second clamping location along said second direction;

an additional terminal electrically connected to said second conducting element, and intended to be connected to a third conducting element.

* * * * *